US012789320B2

(12) United States Patent
Sung

(10) Patent No.: US 12,789,320 B2
(45) Date of Patent: Nov. 10, 2026

(54) PAD CONDITIONER WITH PYRAMIDS OF SINGLE-CRYSTAL DIAMOND

(71) Applicant: Chien-Min Sung, New Taipei City (TW)

(72) Inventor: Chien-Min Sung, New Taipei City (TW)

( * ) Notice: Subject to any disclaimer, the term of this patent is extended or adjusted under 35 U.S.C. 154(b) by 356 days.

(21) Appl. No.: 18/390,512

(22) Filed: Dec. 20, 2023

(65) Prior Publication Data

US 2024/0198481 A1 Jun. 20, 2024

(30) Foreign Application Priority Data

Dec. 20, 2022 (TW) ..... 111149035

(51) Int. Cl.
*B24B 53/017* (2012.01)

(52) U.S. Cl.
CPC ..... *B24B 53/017* (2013.01)

(58) Field of Classification Search
CPC ..... B24B 53/00; B24B 53/017; B24B 53/12; B24D 3/06; B24D 18/00
See application file for complete search history.

(56) References Cited

U.S. PATENT DOCUMENTS

2015/0202735 A1* 7/2015 Liao ..... B24B 53/12 451/443
2015/0283671 A1 10/2015 Chou et al.
2015/0283672 A1* 10/2015 Chou ..... B24B 53/017 451/443
2015/0290768 A1 10/2015 Chou et al.
2016/0346901 A1 12/2016 Chou et al.

* cited by examiner

*Primary Examiner* — Sabbir Hasan
(74) *Attorney, Agent, or Firm* — MUNCY, GEISSLER, OLDS & LOWE, P.C.

(57) ABSTRACT

A pad conditioner with pyramids of single-crystal diamond comprises a substrate and a plurality of single crystal diamond sheets provided on the substrate. Each of the single crystal diamond sheets includes a plurality of single crystal diamond protrusions extended upward away from the substrate and have a tip height. A highest tip height is defined in the single crystal diamond sheet. The number of the single crystal diamond protrusions with the tip height greater than 60 μm is more than ten. The number of the single crystal diamond protrusions with a height difference greater than 60 μm compared to the highest tip is more than ten. A spacing between the adjacent single crystal diamond protrusions is at least two times the tip height.

20 Claims, 6 Drawing Sheets

PAD CONDITIONER WITH PYRAMIDS OF SINGLE-CRYSTAL DIAMOND

FIELD OF THE INVENTION

The present invention relates to a pad conditioner, in particular to a conditioner pad conditioner using a pyramid array of single-crystal diamond as a grinding structure.

BACKGROUND OF THE INVENTION

Chemical mechanical planarization (CMP) is a required process for manufacturing integrated circuits. As circuit line widths decrease in line with Moore's Law, the performance of CMP process becomes increasingly demanding and the number of CMP processes is increased. Take TSMC, the world's largest foundry company, as an example, the 7 nm process requires wafers with a diameter of 300mm (12 inches) to be polished dozens of times. The polishing rate of each CMP must be fast without causing scratches on the wafer, such that a die with tiny size is able to be cut from the wafer by wafer dicing process, involving numerous layers of copper wires spanning over ten kilometers in total length. These wires interconnect billions of transistors arranged on the surface of the silicon substrate. The die, once separated, undergoes fabrication into a chip, serving as a processor (like CPU, GPU, NPU, and other computing hardware) or memory (such as DRAM, flash memories, etc.). In short, CMP is an essential process for highly planarizing surface in fabrication of large-scale wafter products, such as a sapphire wafer.

Specifically, CMP is a polishing method that presses the rotating IC wafer on a rotating polishing pad (usually made of PU). The polishing pad is coated with an abrasive slurry (Slurry) containing nanometers. Abrasive particles (such as $SiO_2$ and $Al_2O_3$) and chemical reagents (such as acid, alkali, hydrogen peroxide); the polishing pad usually contains micropores to adjust the compression ratio and store the refining slurry. When polishing a wafer, the contact area and distribution between the wafer and the polishing pad must be controlled. Therefore, the diamond pad conditioner is utilized to produce suitable sized and evenly distributed asperities on the surface of the polishing pad. If the contact area between the arefer and the polishing pad is too large, the polishing rate will be low and the CMP efficiency will be insufficient; if the contact area between the wafer and the polishing pad is too small, the over polish will be occurred locally, resulting in uneven surface on the wafer (Within wafer non-uniformity, referred to as WIWNU), dishing, erosion or even scratching issues. In addition, the diamond pad conditioner is also used to remove the glaze, which is the hard chips on the polishing pad. Therefore, the tip height distribution of the diamond pad conditioner controls the depth distribution of the diamond penetrating into the polishing pad, which affects various properties of CMP. Therefore, the diamond pad conditioner is a key consumable for CMP performance.

In the diamond pad conditioner, the grinding grits are typically bonded onto a stainless steel base by using metal materials (such as nickel or its alloys). These grinding grits maybe diamond abrasive particles, usually around 150 microns in size. The methods of bonding the grinding grits involve electroplating, brazing, or sintering. However, due to the varied sizes of diamond abrasive particles, significant differences in tip height, and the irregular shapes and fracture surfaces of the particles, maintaining control over the sharpness of the cutting surface becomes challenging. This results in uneven size and distribution of asperities on the polishing pad, consequently impacting CMP efficiency and yield.

Additionally, CMP serves as an interface polishing method, where the pressure distribution at the interface heavily relies on the size and distribution of asperities on the polishing pad. However, the considerable disparity in tip heights among the diamond abrasive particles on the conditioner means that fewer than 500 active particles are effectively utilized for polishing. Consequently, these particles may penetrate the polishing pad and generate excessive asperities. The ten highest diamond abrasive particles can cause penetration too deep (e.g., greater than 60 microns), it amplifies the consumption of polishing pads, which are more costly than the conditioner. The significant discrepancy in tip heights among the diamond abrasive particles not only shortens the lifespan of both the conditioner and polishing pad but also introduces irregularities on the wafer and can lead to scratches, ultimately reducing the wafer yield. Additionally, the frequency of downtime for replacing conditioners and polishing pads increases, diminishing the output volume.

Diamond abrasive particles with smaller size can diminish the disparity in tip heights, but it also reduces the protrusions of the particles. Consequently, this leads to increased friction between the metal that secures the diamond abrasive particles and the grinding slurry. This friction causes contamination of the wafer and decreases the wafer yield. Opting for diamond abrasive particles with consistent crystal shapes can minimize the disparity in tip heights. However, this approach poses a challenge as these diamond abrasive particles might lack sharpness, leaving hard residues on the polishing pad's surface. This, in turn, elevates the occurrence of micro- scratches on the wafer. Hence, the conventional diamond pad conditioner with fixed single crystal diamond abrasive particles is unable to strike a balance between achieving uniform tip heights and ensuring sharpness. Consequently, this inability hampers the improvement of both CoO(Cost of Ownership) and throughput in CMP process.

Another conventional diamond pad conditioner involves using electrical discharge machining on polycrystalline diamond (PCD) sintered sheets or single-crystal diamond sheets formed by the chemical vapor deposition method to produce pyramid-shaped tips, such as US Patent Publication Nos. US20150290768A1, US20150283671A1, US20150283672A1, US20160346901, etc.

However, the above-mentioned diamond ad conditioner with the pyramid array still has shortcomings in the design of the tip height, which has a critical impact on the efficiency and yield of CMP.

SUMMARY OF THE INVENTION

The present disclosure provides a pad conditioner with pyramids of single-crystal diamond, which comprises a substrate and a plurality of single crystal diamond sheets provided on the substrate. Each of the single crystal diamond sheets includes a plurality of single crystal diamond protrusions extended upward away from the substrate and have a tip height. A highest tip height is defined in the single crystal diamond sheet. The number of the single crystal diamond protrusions with the tip height greater than 60 μm is more than ten. The number of the single crystal diamond protrusions with a height difference greater than 60 μm compared to the highest tip height is more than ten. A spacing between the adjacent single crystal diamond protrusions is at least two times the tip height.

3.

Figure 4B:
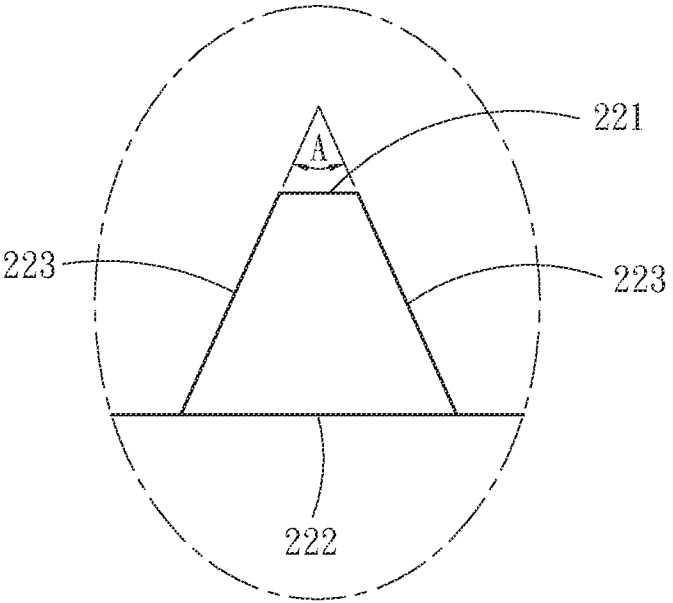
FIG. 4A is a schematic cross-sectional view along B-B of FIG.
Figure 4A:
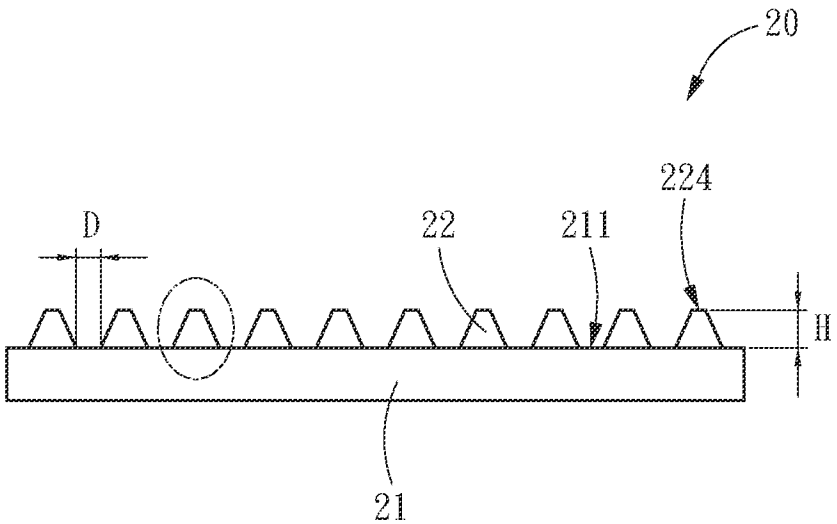

FIG. 4B is a partially enlarged schematic diagram of FIG. 4A.

Figure 5:
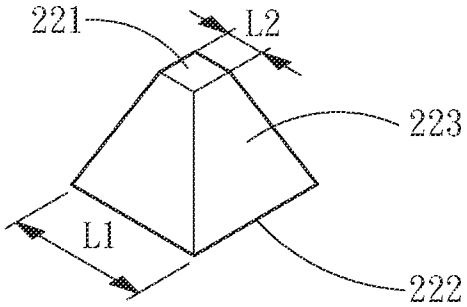

FIG. 5 is a schematic diagram of a single crystal diamond tip according to an embodiment of the present invention.

Figure 6:
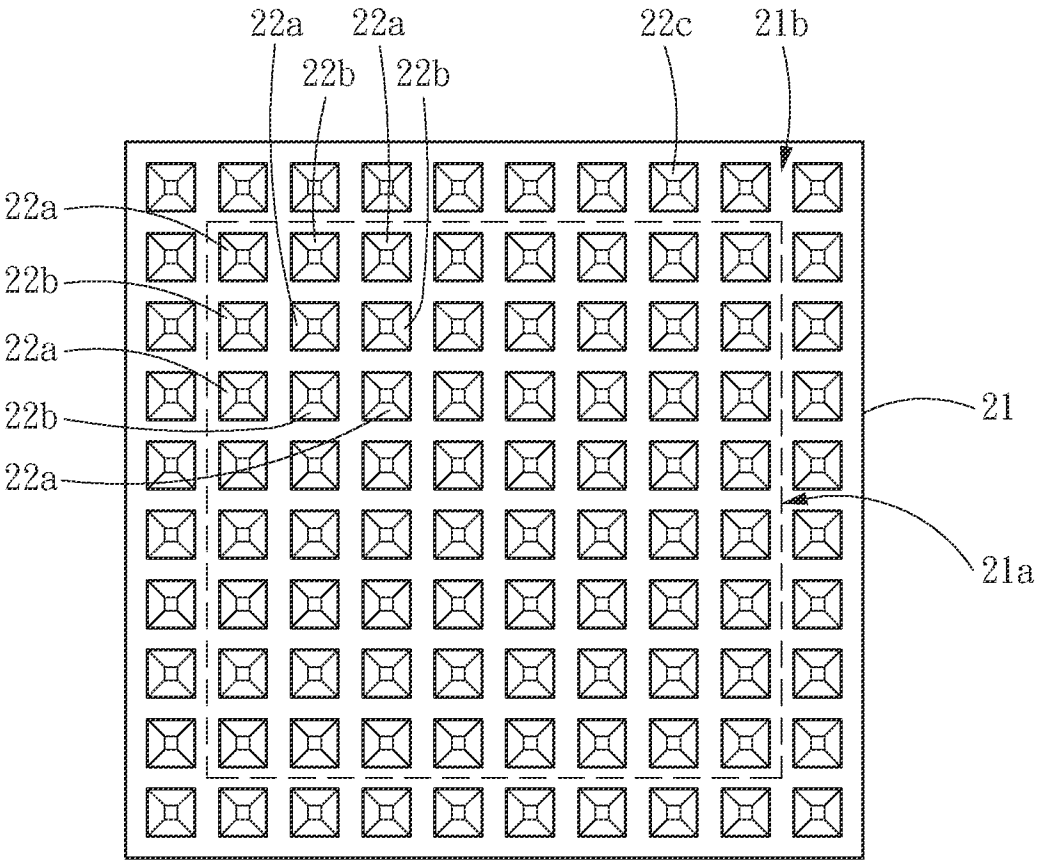

FIG. 6 is a schematic top view of a single crystal diamond sheet according to an embodiment of the present invention.

DETAILED DESCRIPTION OF THE PREFERRED EMBODIMENTS

It is to be understood that the terminology used in the description of the various embodiments and examples herein is for the purpose of describing particular examples only and is not intended to be limiting.

As used herein, the singular forms "a", "an", and "the" include the plural forms as well, unless the context clearly indicates otherwise, which do not denote a limitation of quantity, but rather denote the presence of at least one of the referenced item(s). In addition, the indefinite and definite articles shall include the plural and the singular unless the contrary is clear from the context.

As used herein, the terms "include" and "comprise" indicate the presence of recited features, ingredients, elements and/or compositions, but do not exclude the presence or addition of one or more other features, ingredients, elements, compositions and/or groups thereof.

The present invention, in some embodiments thereof, relates to the field of a diamond pad conditioner for chemical mechanical polishing (CMP) process. The diamond pad conditioner is used to condition the surface of the polishing pad, such that the surface of the polishing pad is re-roughened and maintained at an optimum condition for polishing. The pad conditioner removes the unwanted accumulations on the polishing pad and regenerates the surface of the polishing pad to a desirable asperity. Therefore, the performance of the CMP pad conditioner directly affects the planarization of the wafer surface. The diamond pad conditioner according to the present invention utilizes a diamond single crystal pyramid array to remove waste liquid in the groove of polishing pad, improve the surface roughness and flatness of polishing pad to extend pad life, which finds applicability in the fabrication processes of integrated circuits, central processing units (CPUs), neural network processors (NPU), insulated gate bipolar transistors (IGBT), high electron mobility transistors (HEMT), light-emitting diodes (LEDs), laser discs (LDs), or other optoelectronic components.

Figure 1:
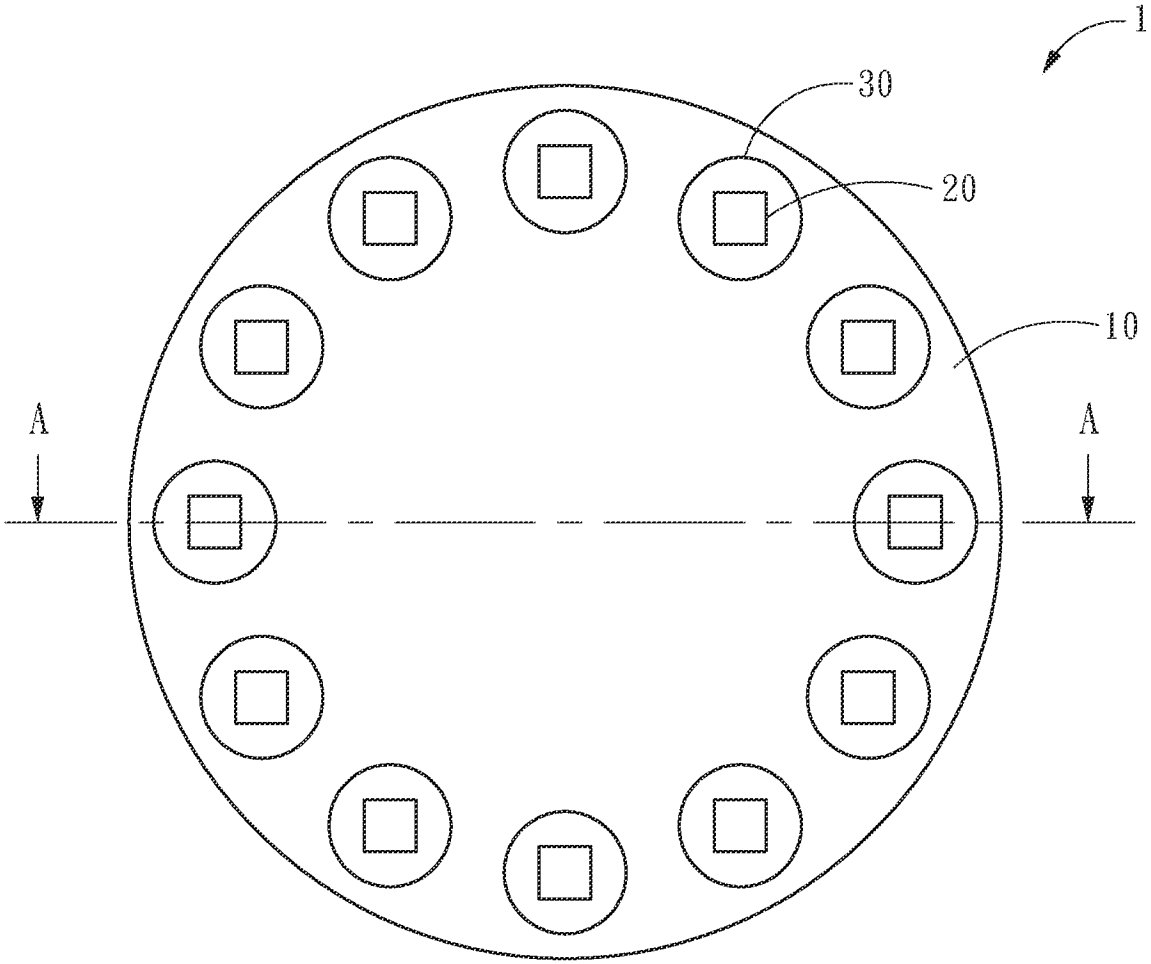
FIG. 1 is a schematic top view according to an embodiment of the present invention.
Figure 2:
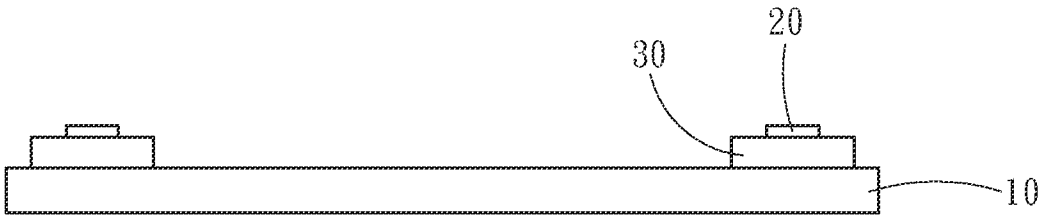
FIG. 2 is a schematic cross-sectional view along A-A of FIG. 1.

Referring to FIG. 1 and FIG. 2, the diamond pad conditioner 1 includes a substrate 10, a plurality of single crystal diamond sheets 20 and a plurality of bases 30. In the following embodiments, the single crystal diamond sheets 20 are affixed to and secured onto the substrate 10 using the bases 30. However, in other embodiments, the single crystal diamond sheets 20 may be directly affixed to and secured onto the substrate 10 without the bases 30. Alternatively, the single crystal diamond sheets 20 may be disposed on the substrate 10 by using other structures or components. The combination of the single crystal diamond sheet 20 with the base 30 is defined as an abrasive unit. In this example, the number of the abrasive units is 12, and the abrasive units are arranged equidistantly along a circumferential direction of the substrate 10.

Figure 3:
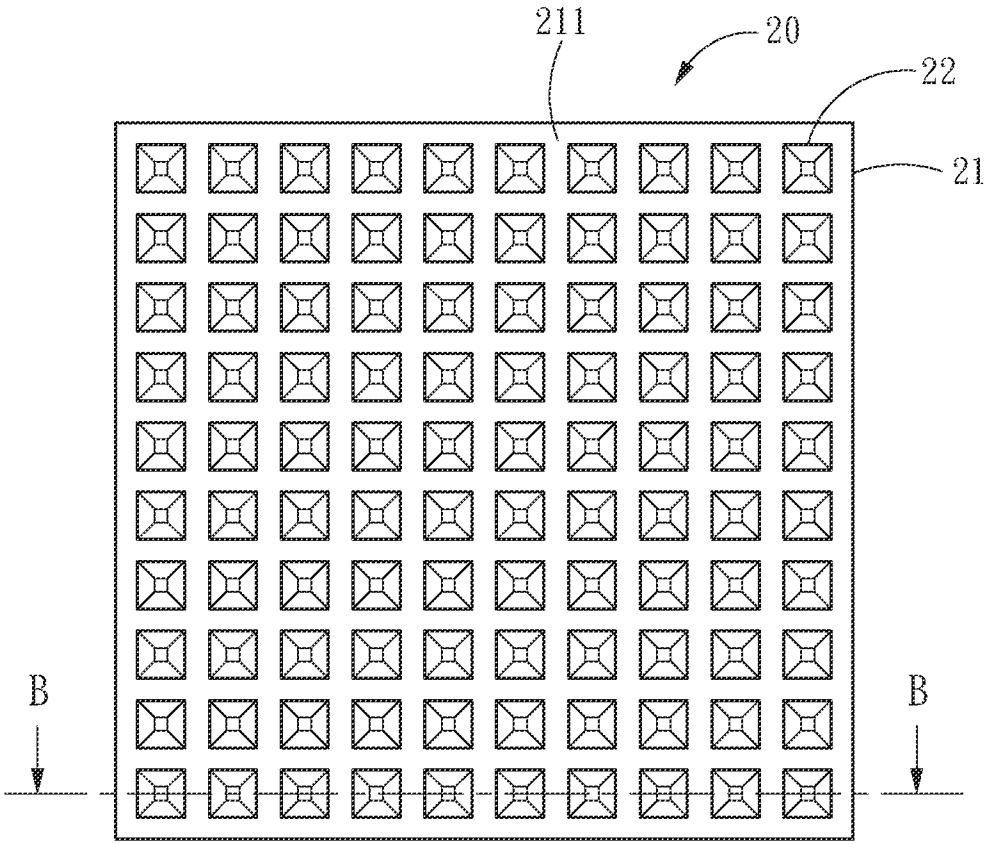
FIG. 3 is a schematic top view of a single crystal diamond sheet according to an embodiment of the present invention.

Referring to FIG. 3 through FIG. 5, each of the single crystal diamond sheets 20 includes a pedestal 21 and a plurality of single crystal diamond protrusions 22. The single crystal diamond protrusions 22 extend upward from the pedestal 21. In this embodiment, each of the single crystal diamond sheets 20 may be made by a gas phase method or a high pressure method. In an example, the single crystal diamond sheets 20 is a chemical vapor deposition diamond (CVDD), which is produced by using laser cutting on a CVD diamond sheet to form a plurality of cones thereon.

The thickness of the single crystal diamond sheet 20 may be greater than 0.5 millimeter (mm). In an example, the thickness of the single crystal diamond sheet 20 may be between 1 mm and 5 mm. The thickness may mean a thickness of the pedestal 21 or a thickness of the single crystal diamond sheet 20 (the pedestal 21 plus the single crystal diamond protrusions 22). In terms of the plane geometry of the single crystal diamond sheet 20, it may be square or rectangular with a size (side length) between 4 mm and 10 mm. In this embodiment, the single crystal diamond protrusions 22 are arranged in an array pattern. In other embodiments, the single crystal diamond protrusions 22 may be arranged in other patterns. The single crystal diamond protrusion 22 is in the shape of a pyramid and has a top platform 221, a bottom surface 222 and a plurality of side inclined surfaces 223 between the top platform 221 and the bottom surface 222. An angle θ formed between one of the side inclined surfaces 223 and its opposite counterpart ranges between 60 degrees and 120 degrees. In one example, a distance D between the adjacent single crystal diamond protrusions 22 ranges between 1 and 10 times a side length L1 of the bottom surface 222 of the single crystal diamond protrusion 22.

According to an embodiment of the present invention, the side length L1 of the bottom surface 222 of each single crystal diamond protrusion 22 is substantially equal, and the side length L2 of the top platform 221 of each single crystal diamond protrusion 22 may vary with different tip heights. In one example, the side length L2 of the top platform 221 of the single crystal diamond protrusion 22 is greater than 20 μm, and the side length L1 of the bottom surface 222 of the single crystal diamond protrusion 22 is greater than 40 μm.

In the diamond pad conditioner 1, the single crystal diamond protrusion 22 has a tip height H, and the tip height H is defined as a distance from a highest point 224 of the single crystal diamond protrusion 22 to an upper surface 211 of the pedestal 21 in a vertical direction. In this example, the highest point 224 is the top platform 221. In the present disclosure, the tip height H may vary among individual single crystal diamond protrusions 22. These variations may result from deliberate design differences, leading to varying values. Hence, there could be a height difference from one protrusion to another. Unless the context clearly indicates otherwise, the tip height H may refer to the height of a specific one of the single crystal diamond protrusions 22, or may refer to the average height of a plurality of the single crystal diamond protrusions 22, or may refer to a range or distribution of the heights of a plurality of the single crystal diamond protrusions 22.

Furthermore, in the diamond pad conditioner 1, the tip heights H of the single crystal diamond protrusions 22 have a distribution of a highest tip height. For example, the highest tip heights may refer to top X % highest tip heights, and X may be any value between 1 and 35, such as 3, 5, 10, 15, 20, and 30. The highest tip height may be defined as a specific value, such as an average of the tip heights of top X % highest protrusions. Alternatively, the highest tip height may be defined as a range, such as all of the tip heights of top X % highest protrusions. In other examples, the highest tip height may be defined as the tip height of top highest protrusions.

In an embodiment, the single crystal diamond protrusions 22 of the pad conditioner 1 satisfy the following requirements:

(a) in the pad conditioner 1, the number of the single crystal diamond protrusions 22 with the tip height greater than 60 μm is more than ten.

(b) in the pad conditioner 1, the number of the single crystal diamond protrusions 22 with a height difference greater than 60 μm compared to a highest protrusion is more than ten.

(c) in the pad conditioner 1, a spacing between the adjacent single crystal diamond protrusions 22 is at least two times the tip height. The tip height herein may be an average of the tip heights of all of the single crystal diamond protrusions 22 on the pad conditioner 1, an average of the tip heights of all of the single crystal diamond protrusions 22 on the single crystal diamond sheet 20 or a tip height of a specific one of the single crystal diamond protrusions 22.

In the above example, requirement (a) may be defined as a first group of the single crystal diamond protrusions 22, and requirement (b) may be defined as a second group of the single crystal diamond protrusions 22. In one example, the first group may account for 40% to 60%, and the remainder is the second group. In another example, the second group may account for 10% to 40%, and the remainder is the first group.

In another embodiment, the single crystal diamond protrusions 22 of the single crystal diamond sheet 20 satisfy the following requirements:

(d) in the single crystal diamond sheet 20, the number of the single crystal diamond protrusions 22 with the tip height greater than 60 μm is more than ten.

(e) in the single crystal diamond sheet 20, the number of the single crystal diamond protrusions 22 with a height difference greater than 60 μm compared to a highest protrusion is more than ten.

(f) in the single crystal diamond sheet 20, a spacing between the adjacent single crystal diamond protrusions 22 is at least two times the tip height. The tip height herein may be an average of the tip heights of all of the single crystal diamond protrusions 22 on the pad conditioner 1, an average of the tip heights of all of the single crystal diamond protrusions 22 on the single crystal diamond sheet 20 or a tip height of a specific one of the single crystal diamond protrusions 22.

In the above example, requirement (d) may be defined as a first group of the single crystal diamond protrusions 22, and requirement (e) may be defined as a second group of the single crystal diamond protrusions 22. In one example, the first group may account for 40% to 60%, and the remainder is the second group. In another example, the second group may account for 10% to 40%, and the remainder is the first group.

For the single crystal diamond protrusions 22 on the diamond pad conditioner 1, it can be understood that the tip heights H of the single crystal diamond protrusions 22 are distributed within a range. In an example of the diamond pad conditioner 1, it is possible that the single crystal diamond protrusions 22 may possess varying tip heights categorized as first, second, and third groups, which may have different values of tip heights or different ranges of tip heights. That is, the single crystal diamond protrusions 22 include a first group with a first tip height, a second group with a second tip height and a third group with a third tip height. Each of the groups may comprise one or more protrusions and the first, second, and third tip heights are different from each other. According to an embodiment of the present invention, among all the single crystal diamond protrusions 22 on the diamond pad conditioner 1, at least fifty percent have a tip height H with a height difference of less than 60 micrometers (μm) compared to the highest protrusion.

According to an embodiment of the present invention, the tip height H of the single crystal diamond protrusions 22 ranges between 50 μm and 500 μm.

According to an embodiment of the present invention, among all the single crystal diamond protrusion 22, the number of the single crystal diamond protrusions 22 with the tip height H less than 60 μm ranges from 300 to 5000.

According to an embodiment of the present invention, among all the single crystal diamond protrusion 22, at least ten of the single crystal diamond protrusions 22 have a difference of the tip height H less than 10 μm. According to another embodiment of the present invention, among all the single crystal diamond protrusion 22, at least one hundred of the single crystal diamond protrusions 22 have a difference of the tip height H less than 10 μm.

According to an embodiment of the present invention, the number of the single crystal diamond protrusions 22 in each of the abrasive units 12 ranges from 10 to 400, and the number of the single crystal diamond protrusions 22 in each of the abrasive units may be same of different.

In the embodiment of FIG. 6, the pedestal 21 of the single crystal diamond sheet 20 may include a central area 21*a* and a periphery area 21*b*, which are defined to set the single crystal diamond protrusions 22 having different tip heights. In one example, the single crystal diamond protrusions 22 include a first group 22*a*, a second group 22*b* and a third group 22*c*. The tip height of the first group 22*a* is greater than that of the second group. 22*b*, the tip height of the second group 22*b* is greater than that of the third group 22*c*. The first group 22*a* and the second group 22*b* are disposed in the central area 21*a* of the pedestal 21, and the third group 22*c* is disposed in the periphery area 21*b* of the pedestal 21. Furthermore, the single crystal diamond protrusions 22 of the first group 22*a* and the second group 22*b* are arranged in the central area 21*a* in a staggered manner. That is, each of the single crystal diamond protrusions 22 of the first groups 22*a* is surrounded by four of the single crystal diamond protrusions 22 of the second groups 22*b*; similarly, each of the single crystal diamond protrusions 22 of the second group 22*b* is surrounded by four of the single crystal diamond protrusions 22 of the first groups 22*a*.

In one example, the tip heights of the single crystal diamond protrusions 22 of the first group 22*a* and the second group 22*b* are respectively less than 20 μm. In another example, the number of the single crystal diamond protrusions 22 of the first group 22*a* accounts for 40% to 60% of the total number of the single crystal diamond protrusions 22, the number of the single crystal diamond protrusions 22 of the second group 22b accounts for 20% to 40% of the total number of the single crystal diamond protrusions 22, while the remainder is the third group 22*c*.

When conditioning by using the diamond pad conditioner 1 of the present invention, at least half of the single crystal diamond protrusions 22 can be penetrated into the polishing pad to a depth greater than 10 μm.

What is claimed is:

1. A pad conditioner with pyramids of single-crystal diamond, comprising:

a substrate;

a plurality of single crystal diamond sheets provided on the substrate, each of the single crystal diamond sheets including a plurality of single crystal diamond protrusions extended upward away from the substrate, each of the single crystal diamond protrusion having a tip height;

wherein a highest tip height is defined in the single crystal diamond sheet;

wherein the single crystal diamond protrusions of the pad conditioner satisfy the following requirements:

a number of the single crystal diamond protrusions with the tip height greater than 60 μm is more than ten;

a number of the single crystal diamond protrusions with a height difference greater than 60 μm compared to the highest tip height is more than ten; and a spacing between respective adjacent single crystal diamond protrusions is at least two times the tip height.

2. The pad conditioner of claim 1, wherein a thickness of the single crystal diamond sheet ranges between 1 mm and 5 mm.

3. The pad conditioner of claim 1, wherein the single crystal diamond protrusion is in a shape of a pyramid.

4. The pad conditioner of claim 1, wherein the single crystal diamond protrusion is formed by using laser cutting machining.

5. The pad conditioner of claim 1, wherein the number of the single crystal diamond protrusions with the tip height less than 60 μm ranges from 300 to 5000.

6. The pad conditioner of claim 1, wherein the single crystal diamond protrusion includes a plurality of side inclined surfaces, and an angle provided between the side inclined surfaces ranges between 60 degrees and 120 degrees.

7. The pad conditioner of claim 1, wherein the spacing between the single crystal diamond protrusions ranges between 1 and 10 times a side length of a bottom surface of the single crystal diamond protrusion.

8. The pad conditioner of claim 1, wherein the single crystal diamond protrusion has a top platform.

9. The pad conditioner of claim 8, wherein a side length of the top platform of the single crystal diamond protrusion is greater than 20 μm, and a side length of a bottom surface of the single crystal diamond protrusion is greater than 40 μm.

10. The pad conditioner of claim 1, wherein the number of the single crystal diamond protrusions of the single crystal diamond sheet ranges from 10 to 400.

11. The pad conditioner of claim 1, wherein a plane geometry of the single crystal diamond sheet is square or rectangular with a size between 4 mm and 10 mm.

12. The pad conditioner of claim 1, wherein the single crystal diamond sheets are made by a gas phase method or a high pressure method.

13. The pad conditioner of claim 1, wherein at least half of the single crystal diamond protrusions are penetrated into a polishing pad to be conditioned to a depth greater than 10 μm.

14. The pad conditioner of claim 1, wherein at least ten of the single crystal diamond protrusions have a difference of the tip height less than 10 μm.

15. The pad conditioner of claim 1, wherein at least one hundred of the single crystal diamond protrusions have a difference of the tip height less than 10 μm.

16. The pad conditioner of claim 1, wherein the tip height of the single crystal diamond protrusions ranges between 50 μm and 500 μm.

17. The pad conditioner of claim 1, wherein the single crystal diamond protrusions include a first group, a second group and a third group, which are categorized based on the tip heights, the tip height of the first group is greater than that of the second group, and the tip height of the second group is greater than that of the third group.

18. The pad conditioner of claim 17, wherein the tip heights of the single crystal diamond protrusions of the first group and the second group are respectively less than 20 μm.

19. The pad conditioner of claim 17, wherein the number of the single crystal diamond protrusions of the first group accounts for 40% to 60% of the total number of the single crystal diamond protrusions, the number of the single crystal diamond protrusions of the second group accounts for 20% to 40% of the total number of the single crystal diamond protrusions, and the remainder is the third group.

20. The pad conditioner of claim 17, wherein the first group and the second group are disposed in a central area of a pedestal of the single crystal diamond sheet, and the third group is disposed in a surrounding area of the pedestal.

* * * * *